US006428005B2

(12) United States Patent
Au-Yeung

(10) Patent No.: US 6,428,005 B2
(45) Date of Patent: Aug. 6, 2002

(54) POKER GAME

(76) Inventor: Chi Fat Au-Yeung, 105 Overdale Road., Quinton B32 2QR (GB)

( * ) Notice: Subject to any disclaimer, the term of this patent is extended or adjusted under 35 U.S.C. 154(b) by 0 days.

(21) Appl. No.: 09/730,295

(22) Filed: Dec. 5, 2000

(30) Foreign Application Priority Data

May 3, 2000 (GB) ..... 0010570

(51) Int. Cl.[7] ..... A63F 9/04
(52) U.S. Cl. ..... 273/274; 273/146; 273/309
(58) Field of Search ..... 273/274, 292, 273/309, 146

(56) References Cited

U.S. PATENT DOCUMENTS 4,648,602 A * 3/1987 Maroney
4,836,553 A * 6/1989 Suttle et al.
5,022,653 A * 6/1991 Suttle et al.
5,224,708 A * 7/1993 Gathman et al.
6,062,563 A * 5/2000 de Keller
6,273,423 B1 * 8/2001 Promutico

* cited by examiner

*Primary Examiner*—William M. Pierce
(74) *Attorney, Agent, or Firm*—Davis & Bujold, P.L.L.C.

(57) ABSTRACT

In a poker game, a player places an initial "ante" bet. The player then throws a first set of five poker dice. The dealer than throws two of a second set of poker dice. The player may then proceed with the game by placing a further "call" bet or may withdraw from the game by passing and losing his "ante" bet. If the player continues, the dealer then throws the remaining three of the second set of dice. The game is decided on the value of the hands thrown by the player and the dealer, the higher ranking poker dice hand winning.

23 Claims, 3 Drawing Sheets

POKER GAME

FIELD OF THE INVENTION

The present invention relates to a casino house game which is a variant of five card stud poker and is played with poker dice.

DESCRIPTION OF THE RELATED ART

Stud poker is a popular game in casinos and the game has been adapted over the years to evolve new variants such as strip deck stud poker.

SUMMARY OF INVENTION

The present invention provides a method of playing a poker game utilising two sets of poker dice.

The game requires a certain degree of skill and decision making which, in turn, makes the game challenging and interesting.

According to one aspect of the present invention, a method of playing a poker game utilising two sets of poker dice, comprises the steps of:

a player throwing a first set of five poker dice;

a dealer throwing two of a second set of five poker dice;

if the player decides to continue with the game, the dealer then throwing the remaining three dice of the second set;

comparing the five dice thrown by the player with the five dice thrown by the dealer, to decide the outcome of the game.

According to the preferred embodiment of the game, the player is required to place a bet before throwing the first set of poker dice. The player is then preferably required to place a further bet, to indicate that he wishes to proceed with the game, before the dealer throws the final three dice of the second set. In addition to the player throwing the dice, further players may bet on the outcome of the game.

The result of the game is decided on the conventional ranking of poker dice hands. If however the hand thrown by the dealer is below a predetermined minimum value, for example a pair of kings, he forfeits the game, paying out the player's initial bet.

According to a further embodiment of the game, if the player wins, the dealer will pay out odds, at least on the player's initial bet, depending on the rank of the hand thrown by the player.

The player may make additional bets on the outcome of the game. Such bets may be subject to the winning hand being of a minimum value, for example a pair of tens, the bet being deemed a stand-off if the minimum value is not achieved and the bet being held over to be decided on the next game.

BRIEF DESCRIPTION OF THE DRAWINGS

The invention will now be described, by way of example, with reference to the accompanying drawings in which.

DETAILED DESCRIPTION OF A PREFERRED EMBODIMENT

Figure 1:
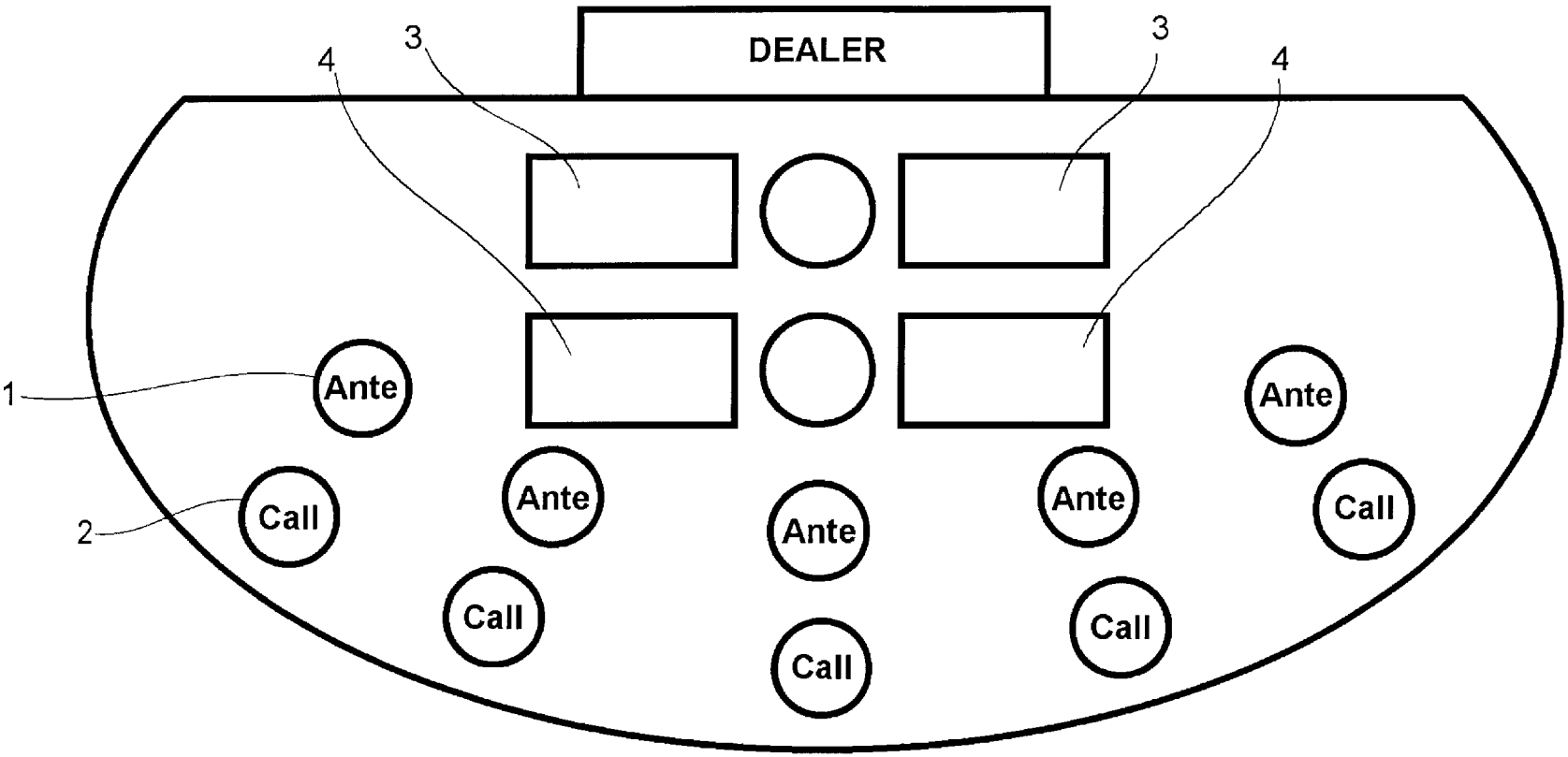
FIG. 1 is a diagrammatic representation showing a layout of the gaming table cloth.
Figure 2:
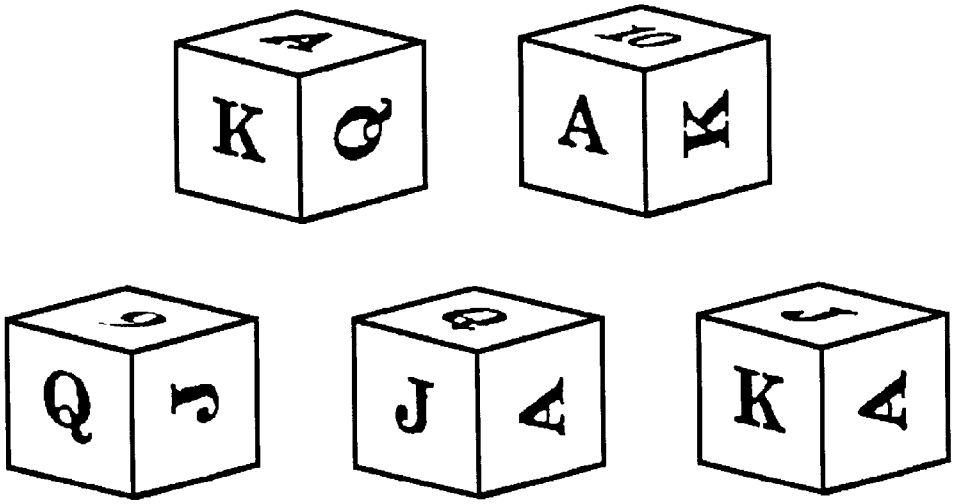
FIG. 2 is a diagrammatic representation of the five poker dice.
Figure 3:
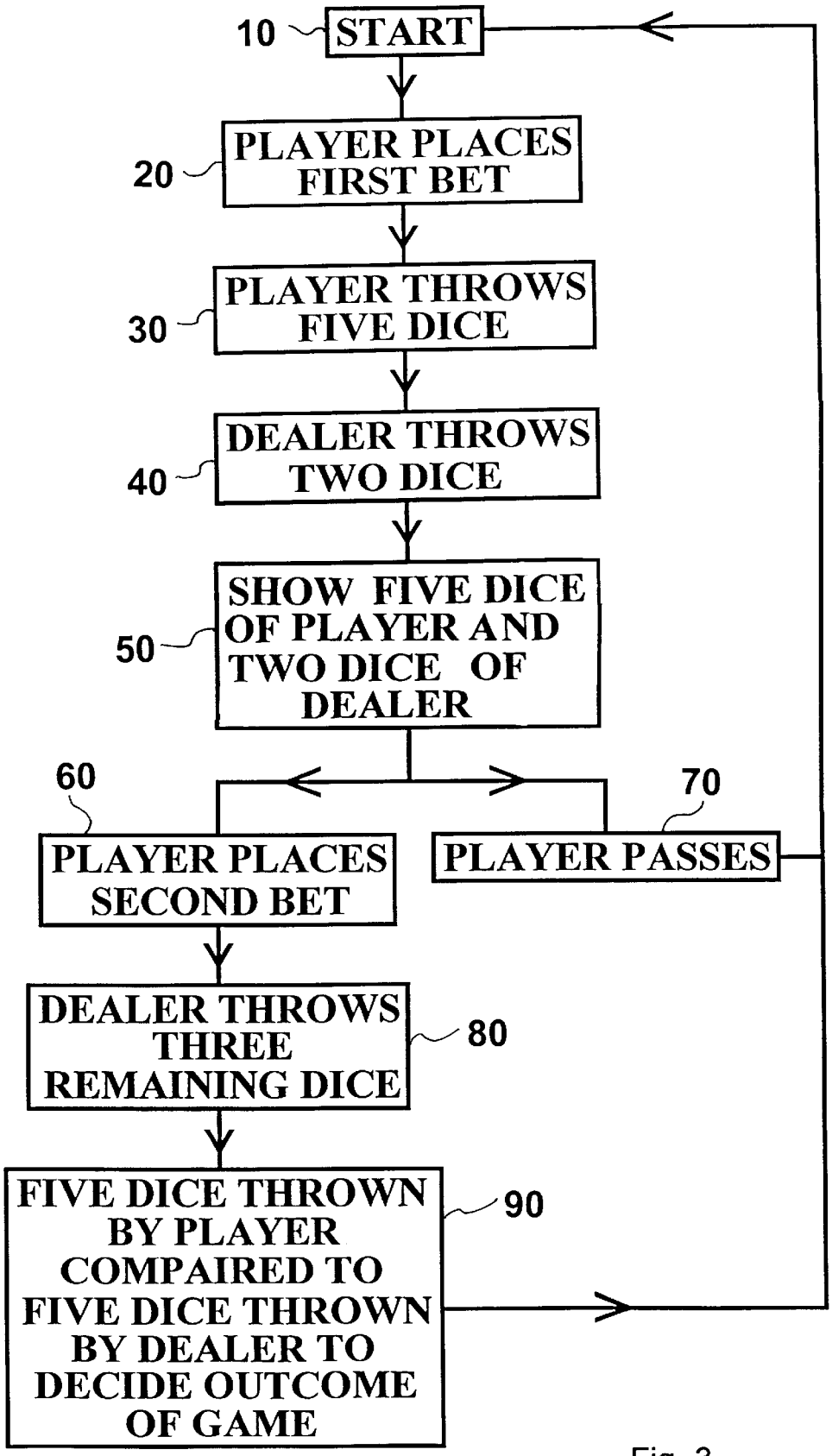
FIG. 3 is a diagrammatic flow diagram of the method according to the present invention.

Referring now to FIGS. 1–3, detailed description concerning the present invention will now provided. Referring to FIG. 1 which illustrates a layout of a gaming table cloth, before starting play (step 10), the player places a bet in the box 1, marked "ante" at step 20. The player then, at step 30, shakes a set of five poker dice each dice (see FIG. 2) comprising six sides, the sides being marked ACE (A); King (K); Queen (Q); Jack (J); 10 and 9. The player shakes the dice in a dice-cup and turns the dice-cup over on the gaming table. The dealer then shakes, at step 40, a second set of poker dice, using two dice-cups, two dice in a first dice-cup and three dice in a second dice-cup and turns the dice-cups over on the gaming table. At step 50, the player's dice-cup and the first of the dealer's dice-cups are then removed revealing the five dice thrown by the player and two of the five dice thrown by the dealer.

If on the basis of the dice revealed, the player decides to continue with the game, then he places a second bet, at step 60, of double his initial bet, in the box 2 marked "call". Alternatively, the player may pass his hand, at step 70, and lose his "ante" bet.

The dealer then removes his second dice-cup, at step 80, revealing the final three dice and the outcome of the game is decided, at step 90, on the better poker hand, on the basis of the conventional poker dice ranking.

Poker Dice Ranking

| Hand | Example |
|---|---|
| Five of a Kind | K, K, K, K, K |
| Four of a Kind | A, A, A, A, J |
| Full House | 10, 10, 10, K, K |
| Straight | A, K, Q, J, 10 |
| Three of a Kind | 10, 10, 10, A, J |
| Two Pairs | K, K, J, J, Q |
| One Pair | K, K, A, Q, 10 |
| High Card Hand | A, K, J, 10, 9 |

If however the dealer's hand is lower than a pair of kings, he fails to qualify and pays the "ante" bet of the player, and any other players who have bet on the outcome of the game.

If the dealer's hand is a pair of kings or better, and he loses to the player then he pays the player and any other players that have bet on the game, their "ante" and "call" bets at even money. If however the dealer's hand is higher than the player's hand then he takes both the player's "ante" and "call" bets.

In addition to placing bets in the "ante" and "call" boxes, players may also place bets on the dealer winning, in box 3, or the player winning, in box 4. If the dealer wins with a hand greater than a pair of tens, then he will pay out on bets placed in box 3 and take bets placed in box 4; while if the player wins with a hand greater than a pair of tens, the dealer will pay out on bets placed in box 4 and will take bets placed in box 3. If the dealer or player wins with a hand having a value of a pair of tens or lower, then the dealer takes losing bets, but the bets on the winning hand are held over and decided on the next game.

A player retains the right to throw the dice as long as he wins, the dice being passed to another player, when the player loses.

According to a further embodiment of the invention, the dealer may pay odds on the "ante" bets if the player wins, the odds depending on the value of the player's hand, for example for five of a kind the dealer may pay out 25 to 1 and for four of a kind 3 to 1 or, for five of a kind the dealer may pay out 20 to 1 and for four of a kind 3 to 1.

Provision can also be made for the players to place bets on the value of the hand thrown by the player and/or dealer, for example, five of a kind; four of a kind or higher; three of a kind or higher; mixed hand. Bets made on the value of the hands may be paid out at appropriate odds.

The above described game may also be adapted for Internet entertainment and video slot machines. It could furthermore be stored on a disk and played on a computer or interactive television.

What is claimed is:

1. A method of playing a poker game utilising two sets of poker dice, comprising the steps of:

a player throwing a first set of five poker dice;

a dealer throwing two dice of a second set of five poker dice;

if the player decides to continue with the game, the dealer then throwing the remaining three dice of the second set of poker dice; and comparing the five dice thrown by the player with the five dice thrown by the dealer to decide the outcome of the game.

2. A method according to claim 1 in which the player is required to place a bet before throwing the first set of dice.

3. A method according to claim 2 in which the player is required to place a second bet to indicate that he wishes to continue with the game, before the dealer throws the final three dice of the second set of dice.

4. A method according to claim 1 in which the dice thrown by the player and the dice thrown by the dealer are compared on the basis of the conventional ranking of poker dice hands.

5. A method according to claim 1 in which if the set of dice thrown by the dealer is below a predetermined value, the dealer forfeits the game.

6. A method according to claim 5 in which if the set of dice thrown by the dealer is below two kings, the dealer forfeits the game.

7. A method according to claim 1 in which if the player wins, the dealer pays out odds depending on the rank of the player's hand.

8. A method according to claim 7 in which if the player wins, the dealer pays out odds of 25 to 1 if the player's hand is five of a kind.

9. A method according to claim 7 in which if the player wins, the dealer pays out odds of 20 to 1 if the player's hand is five of a kind.

10. A method according to claim 7 in which if the player wins, the dealer pays out odds of 3 to 1 if the player's hand is four of a kind.

11. A method according to claim 1 in which further bets may be placed on whether the dealer or the player will win the game.

12. A method according to claim 11 in which if the winning hand is not above a minimum value, the bet is deemed to be a stand-off and is decided on the next game.

13. A method according to claim 12 in which the bet is deemed a stand-off if the winning hand has a value of a pair of tens or lower.

14. A method according to claim 1 in which the dice are shaken in dice-cups and are turned over at the start of the game, the dice being revealed at appropriate times, by removal of the dice-cup.

15. A method according to claim 1 in which further players may bet on the outcome of the game.

16. A method according to claim 1 in which further bets may be placed on the value of the hand thrown by one of, the dealer, the player and the dealer and player.

17. A method of playing a poker game utilising two sets of poker dice comprising the steps of:

a player making a first bet;

the player throwing a first set of five poker dice;

the dealer throwing two dice of a second set of poker dice;

the player placing a second bet, if he wishes to continue or forgoing his first bet if he does not wish to continue;

upon placement of the second bet, the dealer throwing the remaining three of the second set of poker dice; and comparing the five dice thrown by the player with the five dice thrown by the dealer to decide the outcome of the game, the player losing his first and second bets if the dealer wins and the dealer paying out on the first and second bets if the player wins.

18. A method according to claim 17 in which the hands are compared on the basis of the conventional ranking of poker dice hands.

19. A method according to claim 17 in which if the dealer's hand is below a predetermined value he forfeits the game and pays out on the player's first bet only.

20. A method according to claim 17 in which if the player wins, the dealer pays out odds depending on the rank of the player's hand.

21. A method according to claim 20 in which if the player wins, the dealer pays out odds of 25 to 1 on the player's first bet, if the player's hand is five of a kind.

22. A method according to claim 20 in which if the player wins, the dealer pays out odds of 20 to 1 on the player's first bet, if the player's hand is five of a kind.

23. A method according to claim 20 in which if the player wins, the dealer pays out odds of 3 to 1 on the player's first bet, if the player's hand is four of a kind.

* * * * *